US012225974B2

(12) United States Patent
Ohira

(10) Patent No.: US 12,225,974 B2
(45) Date of Patent: Feb. 18, 2025

(54) INSOLE

(71) Applicant: JAPAN FOOT CARE SERVICE CO., LTD., Kyoto (JP)

(72) Inventor: Yoshio Ohira, Kyoto (JP)

(73) Assignee: JAPAN FOOT CARE SERVICE CO., LTD., Kyoto (JP)

( * ) Notice: Subject to any disclaimer, the term of this patent is extended or adjusted under 35 U.S.C. 154(b) by 0 days.

(21) Appl. No.: 18/694,657

(22) PCT Filed: Jun. 26, 2023

(86) PCT No.: PCT/JP2023/023540

§ 371 (c)(1),
(2) Date: Mar. 22, 2024

(87) PCT Pub. No.: WO2024/004929

PCT Pub. Date: Jan. 4, 2024

(65) Prior Publication Data

US 2024/0335005 A1 Oct. 10, 2024

(30) Foreign Application Priority Data

Jun. 27, 2022 (JP) ..... 2022-102417

(51) Int. Cl.

| | |
|---|---|
| ***A43B 17/00*** | (2006.01) |
| ***A43B 7/143*** | (2022.01) |
| ***A43B 7/144*** | (2022.01) |
| ***A43B 7/24*** | (2006.01) |
| ***A43B 17/02*** | (2006.01) |

(52) U.S. Cl.
CPC ..... *A43B 17/003* (2013.01); *A43B 7/143* (2013.01); *A43B 7/144* (2013.01); *A43B 7/24* (2013.01); *A43B 17/023* (2013.01)

(58) Field of Classification Search
None
See application file for complete search history.

(56) References Cited

U.S. PATENT DOCUMENTS 3,466,763 A * 9/1969 Levin ..... A43B 5/02 36/134
4,235,028 A * 11/1980 Riggs ..... A43B 21/32 36/80
4,338,734 A * 7/1982 Schwartz ..... A43B 7/22 36/44

(Continued)

FOREIGN PATENT DOCUMENTS

CN 1765250 A 5/2006
CN 104270982 A 1/2015

(Continued)

OTHER PUBLICATIONS

Taiwanese Office Action and Search Report for Taiwanese Application No. 112123895, dated Apr. 19, 2024, with English translation.

(Continued)

*Primary Examiner* — Jila M Mohandesi
(74) *Attorney, Agent, or Firm* — Birch, Stewart, Kolasch & Birch, LLP

(57) ABSTRACT

An insole includes a heel cup portion supporting a heel, in which the heel cup portion has an outer height higher than an inner height.

2 Claims, 3 Drawing Sheets

(56) References Cited

U.S. PATENT DOCUMENTS

| | | | | |
|---|---|---|---|---|
| 4,402,146 | A * | 9/1983 | Parracho | A43B 5/06 36/129 |
| 4,866,861 | A * | 9/1989 | Noone | A43B 5/001 36/134 |
| 4,882,856 | A * | 11/1989 | Glancy | A43B 7/24 36/43 |
| 6,474,006 | B1 * | 11/2002 | Cummings | A43B 7/24 36/144 |
| 6,497,058 | B2 * | 12/2002 | Dietrich | A43B 13/14 36/31 |
| 6,594,922 | B1 * | 7/2003 | Mansfield | A43B 23/081 36/173 |
| 8,099,880 | B2 * | 1/2012 | Brewer | A43B 13/187 36/35 R |
| 9,668,537 | B2 * | 6/2017 | Pedersen | A43B 7/24 |
| 11,064,766 | B2 | 7/2021 | Kfir | |
| 2001/0001907 | A1 * | 5/2001 | Luthi | A43B 7/1425 36/144 |
| 2003/0177667 | A1 * | 9/2003 | Hussain | A43B 7/1455 36/43 |
| 2004/0181971 | A1 | 9/2004 | Turkbas et al. | |
| 2004/0194344 | A1 * | 10/2004 | Tadin | A43B 7/144 36/173 |
| 2006/0090377 | A1 | 5/2006 | Segalin | |
| 2013/0067764 | A1 | 3/2013 | Riddle | |
| 2015/0075030 | A1 * | 3/2015 | Walborn | A43B 7/141 36/44 |
| 2015/0196086 | A1 | 7/2015 | Riddle | |
| 2015/0201702 | A1 | 7/2015 | Paul et al. | |
| 2015/0237959 | A1 | 8/2015 | Wynn et al. | |
| 2017/0027277 | A1 | 2/2017 | Anthony et al. | |
| 2019/0125032 | A1 | 5/2019 | Liu | |

FOREIGN PATENT DOCUMENTS

| | | | |
|---|---|---|---|
| CN | 104544726 | A | 4/2015 |
| CN | 204246293 | U | 4/2015 |
| CN | 104918509 | A | 9/2015 |
| CN | 106562516 | A | 4/2017 |
| CN | 108113117 | A | 6/2018 |
| JP | 9-98806 | A | 4/1997 |
| JP | 2004-194734 | A | 7/2004 |
| JP | 2008-220795 | A | 9/2008 |
| JP | 2013-103019 | A | 5/2013 |
| JP | 2014-8298 | A | 1/2014 |
| JP | 2015-526251 | A | 9/2015 |
| JP | 2019-80912 | A | 5/2019 |
| JP | 2021-62164 | A | 4/2021 |
| KR | 10-2140044 | B1 | 8/2020 |
| TW | M414846 | U1 | 11/2011 |
| TW | M628092 | U | 6/2022 |
| WO | WO 2019/044508 | A1 | 3/2019 |

OTHER PUBLICATIONS

International Search Report for PCT/JP2023/023540 (PCT/ISA/210) mailed on Aug. 15, 2023.

Written Opinion of the International Searching Authority for PCT/JP2023/023540 (PCT/ISA/237) mailed on Aug. 15, 2023.

Korean Office Action for Korean Application No. 10-2024-7023392, dated Aug. 19, 2024, with English translation.

Taiwanese Office Action for Taiwanese Application No. 112123895, dated Sep. 3, 2024, with English translation.

Chinese Office Action and Search Report for Chinese Application No. 202380013800.4, dated Jul. 5, 2024, with English translation.

Office Action issued in Chinese Patent Application No. 202380013800.4, dated Nov. 21, 2024.

Supplementary European Search Report issued in Application No. 23828677.7, dated Dec. 17, 2024.

* cited by examiner

INSOLE

TECHNICAL FIELD

The present invention relates to an insole.

BACKGROUND ART

An insole mounted on a shoe is known. Patent Document 1 discloses an example of an insole. The insole includes a heel cup portion that supports a heel of a foot portion. The heel cup portion covers the inner side, outer side, and back side of the heel. A height of the heel cup portion is substantially constant.

PRIOR ART DOCUMENTS

Patent Documents

Patent Document 1: Japanese Patent Laid-open Publication No. 2021-62164

SUMMARY OF THE INVENTION

Problems to be Solved by the Invention

In a case where a subtalar joint performs pronation, a twisting force acts on a knee joint due to a lower leg being twisted inward, and each tissue constituting the knee joint is damaged. In a case where the pronation of the subtalar joint is continued for a long time, the knee joint becomes unstable, so that the knee joint is likely to upset in a left-right direction. The upset of the knee joint in the left-right direction causes a decrease in performance and occurrence of injury in sports games such as golf and basketball. Furthermore, the upset of the knee joint in the left-right direction hinders treatment, pain reduction, and prevention of knee osteoarthritis. The above-described insole has not been considered such a point.

An object of the present invention is to provide an insole capable of suppressing the knee joint from being upset in the left-right direction.

Means for Solving the Problem

An insole according to a first aspect of the present invention is an insole including a heel cup portion supporting a heel, in which the heel cup portion has an outer height higher than an inner height.

The foot portion is composed of a lateral column including the calcaneus and a medial column including the talus. The talus and calcaneus have pronation and supination motion axes at the subtalar joint, and these motions affect the motion axes of the talonavicular and calcaneocuboid joints. Since the talonavicular joint axis and the calcaneocuboid joint axis are parallel in the pronation of the subtalar joint, a range of joint motion becomes large, so that the foot portion becomes soft. On the other hand, in the supination of the subtalar joint, the talonavicular joint axis and the calcaneocuboid joint axis cross each other, and the range of joint motion is reduced, so that the foot portion is stiff. Note that the pronation is a combined motion of dorsal flexion, eversion, and outward inversion, and the supination is a combined motion of plantarflexion, adduction, and inward inversion.

According to the insole, since the height of the outer side of the heel cup portion is higher than the height of the inner side, the outward inversion motion of the calcaneus, which is an element of pronation, is restricted. Since the subtalar joint can be suitably guided from a pronation position to an intermediate position, the knee joint is stabilized. Therefore, it is possible to suppress the knee joint from being upset in the left-right direction.

An insole according to a second aspect of the present invention is the insole according to the first aspect, and includes: a weight support portion constituting the heel cup portion; and a reinforcement portion joined to a bottom surface of the weight support portion.

According to the insole, the rigidity of the weight support portion is enhanced.

An insole according to a third aspect of the present invention is the insole according to the second aspect, in which the reinforcement portion includes an outer reinforcement portion joined to the weight support portion so as to be able to support an outer side of a foot.

According to the insole, since the rigidity of the outer side of the weight support portion is increased by the outer reinforcement portion, it is possible to suppress the outer side of a foot portion from sinking in a case where a load is applied. For this reason, the holding of an outer longitudinal arch is promoted, in other words, a force in an outward inversion direction is continuously applied to a transverse tarsal joint.

When the force in the outward inversion direction is applied to the transverse tarsal joint, the shapes of adjacent calcaneal and cuboidal joints cause the two bones to mesh with each other, causing compressive stress. Therefore, the transverse tarsal joint is locked. Note that the calcaneus belongs to a unit called "hind foot" (posterior portion of foot composed of talus and calcaneus), and the cuboid bone belongs to a unit called "front foot" (all bones in front of the unit except the talus and the calcaneus).

In a case where the transverse tarsal joint is locked, the joint between the hind foot and the front foot is strengthened, so that the rigidity of the entire foot portion is enhanced. Therefore, the stability of the foot portion, the lower limb, and the body is improved.

Furthermore, since the rigidity of the outer side of the weight support portion is increased, it is possible to suppress falling of the foot portion outward, falling of the lower leg outward, falling of the thigh outward, falling of the body in the left-right direction, displacement of the center of gravity in the left-right direction, and the like. Furthermore, since the joint between the front foot and the hind foot becomes strong, it is possible to suppress generation of a force that causes a joint located above the foot portion to bend in the left-right direction. Note that examples of the joint located above the foot portion include an ankle joint between the foot portion and the lower leg, a knee joint between the lower leg and the thigh, a hip joint between the thigh and the pelvis, a sacral vertebral joint between the pelvis and the vertebrae, and an intervertebral joint between the vertebrae. In particular, in a case where the knee joint is described as a specific example, when the lower leg falls outward, the knee joint is displaced outward from a position where the knee joint originally located, so that an adduction force, that is, a force promoting a so-called O leg acts on the knee joint. According to the insole, the application of such a force to the knee joint is suppressed.

An insole according to a fourth aspect of the present invention is the insole according to the third aspect, in which the reinforcement portion further includes: a first support portion supporting a bone head bottom surface of a first metatarsal; and a second support portion joined to the first support portion and supporting a bone head bottom surface of a second metatarsal to a bone head bottom surface of a fifth metatarsal, and a material constituting the first support portion is softer than a material constituting the second support portion.

According to the insole, the bone head of the first metatarsal can drop lower than from the bone head of the second metatarsal to the bone head of the fifth metatarsal, and thus, for example, in a golf swing motion, a state in which the first row of the foot portion is in plantarflexion can be smoothly formed. Since a user can easily recognize the bone head of the first metatarsal, for example, the user can easily execute a motion of kicking the bone head of the first metatarsal, which is important in the golf swing motion, in other words, a motion of kicking the ground with the thenar.

Advantages of the Invention

According to the insole of the present invention, it is possible to suppress the knee joint from being upset in the left-right direction.

EMBODIMENTS OF THE INVENTION

Figure 1:
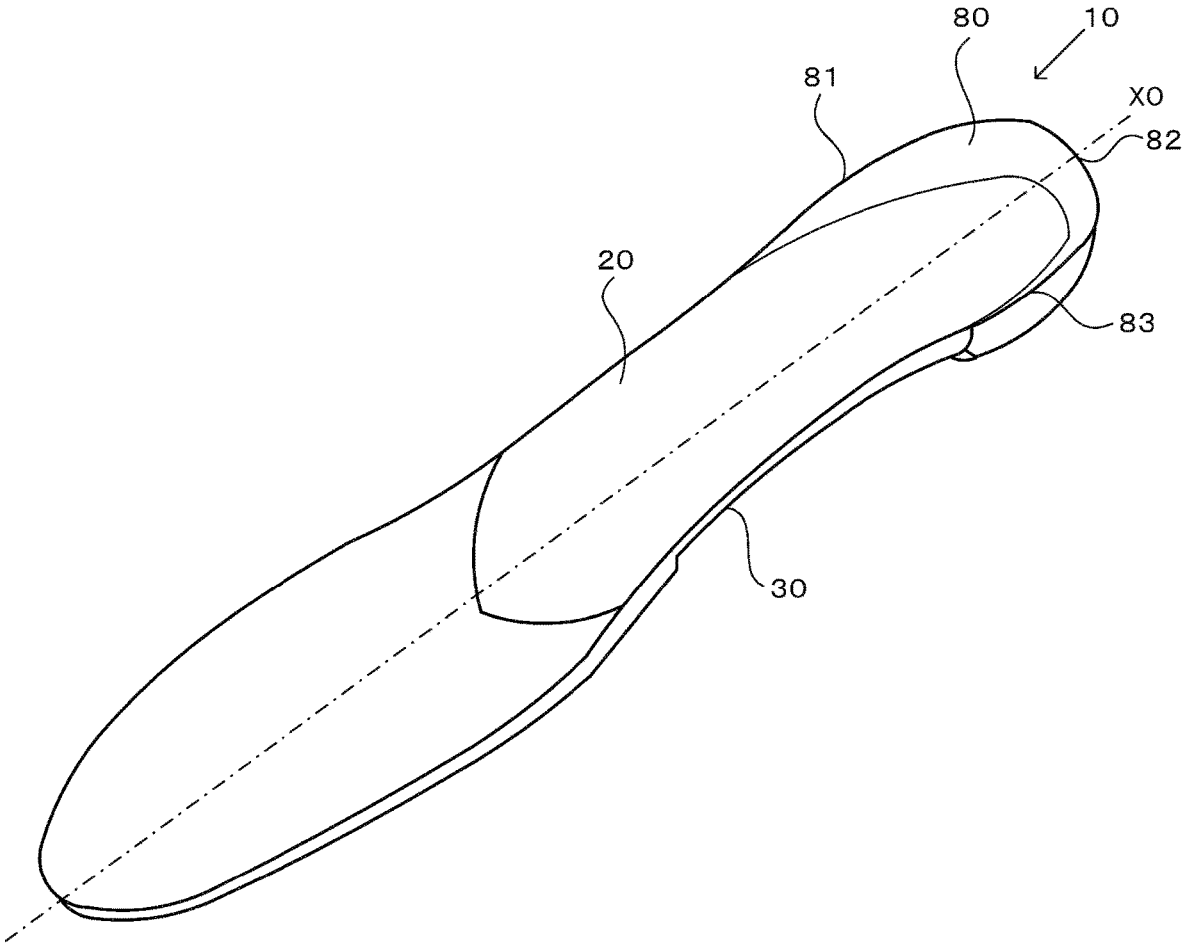
FIG. 1 is a perspective view of an insole according to an embodiment.
Figure 2:
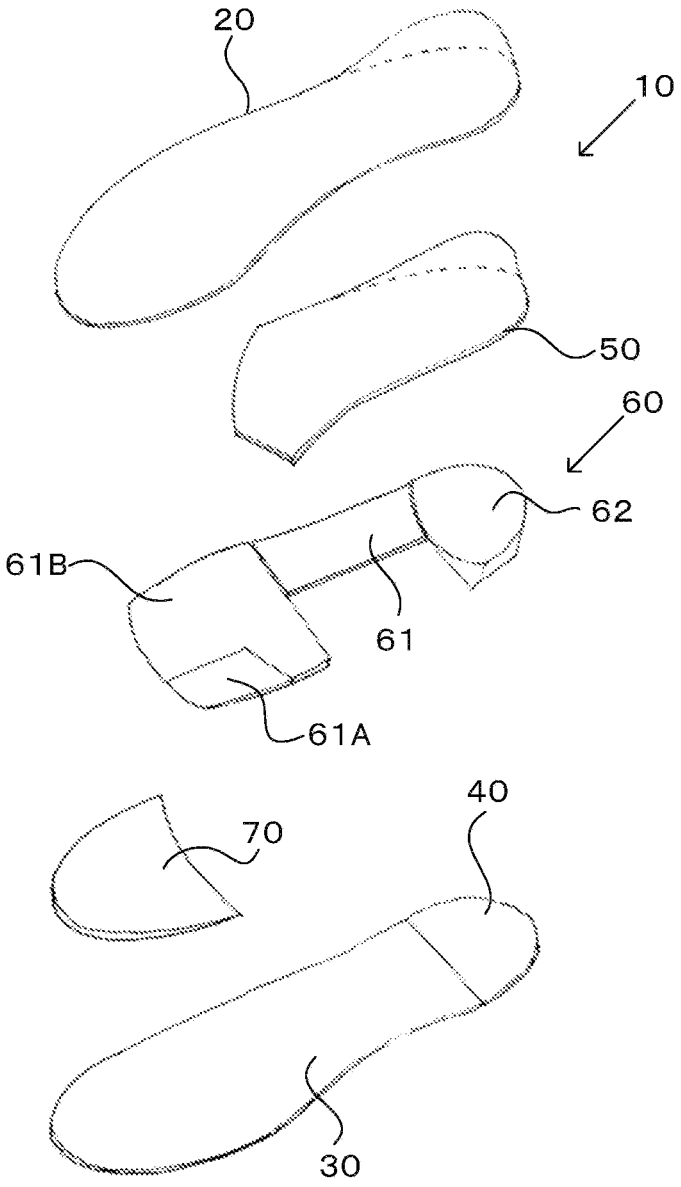
FIG. 2 is an exploded perspective view of the insole of FIG. 1.
Figure 3:
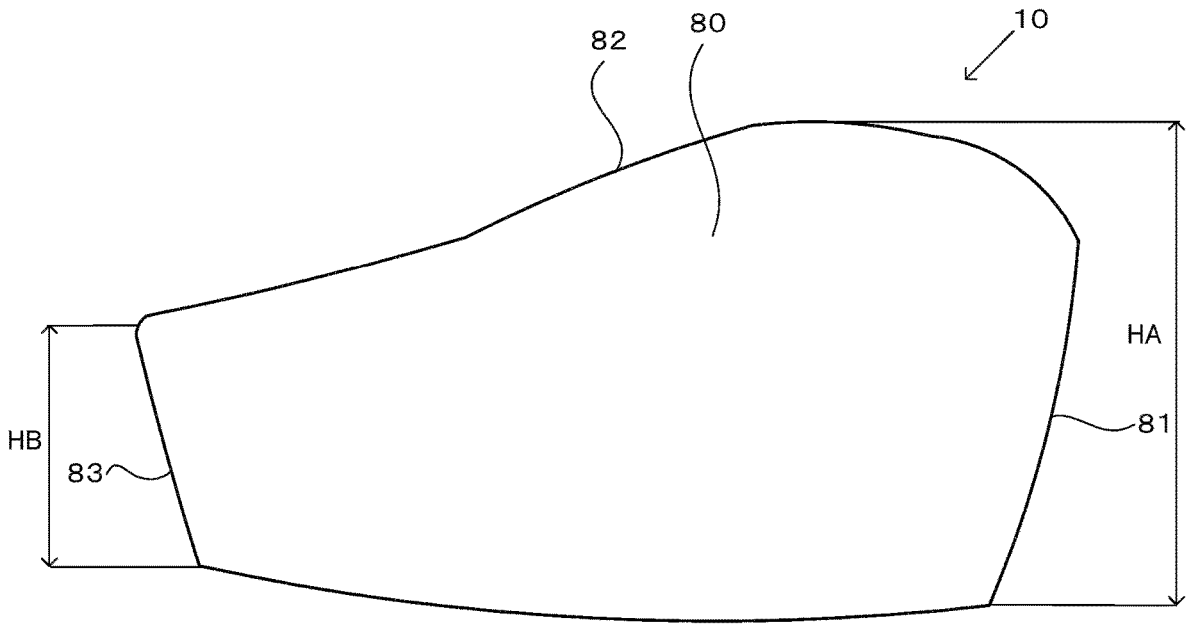
FIG. 3 is a rear view of the insole of FIG. 1.

Hereinafter, an embodiment of an insole according to the present invention will be described with reference to the drawings. FIG. 1 is a perspective view of an insole 10 (hereinafter referred to as "insole 10") of an embodiment. FIG. 2 is an exploded perspective view of the insole 10 of FIG. 1. FIG. 3 is a rear view of the insole 10 of FIG. 1.

<1. Configuration of Insole>

Conventional insoles are classified into adaptive insoles and functional insoles. The adaptive insole is used mainly for the purpose of dispersing pressure acting on a sole. For this reason, in the adaptive insole, a weight support portion is configured of, for example, a soft resin such as a urethane resin or an ethylene vinyl acetate (EVA) resin, or a compound such as rubber. In the adaptive insole, the weight support portion is easily plastically deformed by a load acting on the weight support portion. Furthermore, since the material constituting the weight support portion is soft, an assisting force for guiding a foot portion to an intermediate position cannot be suitably obtained. However, since the adaptive insole can easily change the thickness, hardness, and the like partially, the support property, cushioning property, impact absorption property, and the like can be easily changed partially. Note that the intermediate position is a position where the subtalar joint is not a pronation position or a supination position. In the intermediate position of the subtalar joint, the foot portion can exert its function to the maximum.

On the other hand, the functional insole is mainly used for the purpose of guiding the foot portion to the intermediate position. In the functional insole, a weight support portion is configured of a relatively hard material such as polypropylene, polyethylene, carbon fiber, or glass fiber in order to guide the foot portion to the intermediate position. For this reason, in the functional insole, it is difficult to adjust the support property and repulsion property of the weight support portion at an arbitrary portion. Furthermore, in the functional insole, a heel cup portion is formed deeply to increase the controllability of the foot portion, but a heel portion of a shoe is pushed and spread outward. Therefore, the fit feeling between the foot and the shoe is lowered. The insole 10 illustrated in FIG. 1 is configured to eliminate the disadvantages of conventional adaptive insoles and functional insoles. The insole 10 is a so-called hybrid insole having characteristics of the adaptive insole and characteristics of the functional insole.

The insole 10 illustrated in FIG. 1 is configured to prevent the knee joint from being upset in the left-right direction by guiding the subtalar joint to the intermediate position. The upset of the knee joint to the left and right causes a decrease in performance and occurrence of injury in sports. The sports competition is, for example, a competition in which a side step is performed, a competition in which a feint motion is performed in the left-right direction, or a competition in which the body is required to hold out so as not to be unstable in an outward direction. Specific examples of the sports competition include golf, tennis, table tennis, basketball, soccer, dance, and athletics. According to the insole 10, deterioration in performance and occurrence of injury are suppressed in the sports competition. Furthermore, the upset of the knee joint in the left-right direction hinders treatment, pain reduction, and prevention of knee osteoarthritis. According to the insole 10, effects can be expected also in terms of treatment, pain reduction, and prevention of knee osteoarthritis.

The insole 10 illustrated in FIG. 1 is, for example, an insole for a right foot used by being worn on a shoe for the right foot. The insole 10 may be worn on a shoe used in, for example, golf, tennis, table tennis, basketball, soccer, dance, athletics, or may be worn on a shoe of a patient with knee osteoarthritis or a person who has pain in the knee joint. The insole 10 is configured to guide the subtalar joint of the right foot of the user in the intermediate position. An insole that guides the subtalar joint of a left foot of the user to the intermediate position has the same configuration as the insole illustrated in FIG. 1 and the like except that the insole is configured to be inverted left and right with respect to a center line XO, and thus the description thereof will be omitted. Note that, in the following description, in a case where the foot is placed on the insole 10, a side where the thenar exists with respect to the center line XO may be referred to as an inner side, and a side opposite to the inner side may be referred to as an outer side.

The insole 10 has a shape in which a portion corresponding to an inner longitudinal arch is raised so that the subtalar joint can be guided to the intermediate position. The insole 10 includes a top cover 20, a bottom cover 30, a heel grip 40, a weight support portion 50, a reinforcement portion 60, and an extension 70. In the insole 10, the top cover 20, the bottom cover 30, the heel grip 40, the weight support portion 50, the reinforcement portion 60, and the extension 70 are joined to each other. The elements constituting the insole 10 are joined to each other by, for example, an adhesive.

The top cover 20 is located at the top of the elements constituting the insole 10. The top cover 20 is joined so as to follow a top surface shape of each element constituting the insole 10 including the weight support portion 50 or so as to be in close contact with the top surface shape. The top cover 20 is in contact with the sole of the right foot of the user. A material constituting the top cover 20 can be arbitrarily selected. In the present embodiment, the material constituting the top cover 20 is, for example, a sheet material in which synthetic vinyl and a back cloth are joined. The material constituting the top cover 20 may be a material having a cushioning property in order to reduce impact on a bottom surface of the foot portion. The material having a cushioning property is, for example, a sheet material such as foamed urethane or foamed EVA.

The bottom cover 30 is located at the bottom of the elements constituting the insole 10. The bottom cover 30 is placed on an inner bottom of the shoe. In other words, a footbed previously inserted into the shoe is removed, and the insole 10 is used instead of the footbed. The bottom cover 30 is joined to each element constituting the insole 10 so as to follow a bottom surface shape of the insole or to be in close contact with the bottom surface shape. A material constituting the bottom cover 30 can be arbitrarily selected. In the present embodiment, the material constituting the bottom cover 30 is, for example, a sheet material such as synthetic suede.

The heel grip 40 prevents the insole 10 from slipping with respect to the sole of the shoe. A top surface of the heel grip 40 is joined to a bottom surface of a hind foot post 62 along or in close contact with the hind foot post 62. A distal end of the heel grip 40 is joined to a rear end of the bottom cover 30. A material constituting the heel grip 40 can be arbitrarily selected. In the present embodiment, the material constituting the heel grip 40 is a sheet material in which rubber and a back cloth are joined.

The weight support portion 50 covers from a heel portion to the vicinity of the bone head of the metatarsal (not including the bone head of the metatarsal) in the right sole. The weight support portion 50 has a shape modified to a plantar shape so as to guide the subtalar joint to the intermediate position. A top surface of the weight support portion 50 is joined to a bottom surface of the top cover 20. A material constituting the weight support portion 50 can be arbitrarily selected. The weight support portion 50 is preferably made of a material having a certain degree of rigidity or a material having repulsion so that the subtalar joint can be guided to the intermediate position. In the present embodiment, the material constituting the weight support portion 50 is, for example, a sheet material such as polypropylene, polyethylene, carbon fiber reinforced plastics (FRP), or glass FRP.

In the present embodiment, a part of the top cover 20 and a part of the weight support portion 50 constitute a heel cup portion 80 that covers a part of the heel of the right foot. As illustrated in FIG. 3, the heel cup portion 80 has an outer portion 81, a rear portion 82, and an inner portion 83. The outer portion 81 covers a part of the outer side of the heel of the right foot. The rear portion 82 covers a part of the rear of the heel of the right foot. The inner portion 83 covers a part of the inner side of the heel of the right foot. In the heel cup portion 80, a height HA of the outer portion 81 is higher than a height HB of the inner portion 83 so that the subtalar joint of the right foot of the user can be guided to the intermediate position. In other words, in the heel cup portion 80, a height of a portion corresponding to an outer side of a side surface of the heel is higher than a height of a portion corresponding to an inner side of the side surface of the heel. That is, the insole 10 is configured such that when the foot portion is placed, the portion corresponding to the outer side of the side surface of the heel covers a position higher than the portion corresponding to the inner side of the side surface of the heel. The height HA is preferably in a range of 15 mm to 25 mm, for example. The height HA is, for example, 20 mm. The height HB is preferably in a range of 5 mm to 15 mm, for example. The height HB is, for example, 10 mm. A difference ΔH between the height HA and the height HB can be arbitrarily selected. The difference ΔH is preferably about 10 mm so that the subtalar joint can be suitably guided to the intermediate position. In a longitudinal direction of the insole 10 (direction in which the center line XO extends), the outer portion 81 is preferably formed up to a portion corresponding to the calcaneus or the vicinity of a base portion of the fifth metatarsal.

At a frontal plane of the body in a basic upright position (looking directly forward at the body in the basic upright position), there is a center line (hereinafter, referred to as a "body center line of the frontal plane") dividing the body into the left and right. In a horizontal plane of the foot portion in the basic upright position (looking at the body from directly above in the basic upright position), there is a center line (hereinafter referred to as "foot center line of the horizontal plane") dividing the foot portion into the inner side and the outer side. The inner side of the foot portion is a side close to the body center line of the frontal plane with the foot center line of the horizontal plane as a boundary in the foot portion of the basic upright position. The outer side of the foot portion is opposite the inner side of the foot portion, i.e., away from the body center line of the frontal plane, with the foot center line of the horizontal plane as a boundary.

The reinforcement portion 60 includes an outer reinforcement portion 61, a first support portion 61A, a second support portion 61B, and a hind foot post 62. The reinforcement portion 60 suppresses excessive elastic deformation of the weight support portion 50. In other words, the reinforcement portion 60 suppresses excessive bending or excessive sinking of the weight support portion 50 due to the load. Furthermore, the reinforcement portion 60 enhances rigidity and support, or enhances repulsion.

The outer reinforcement portion 61 is located between the weight support portion 50 and the bottom cover 30. The outer reinforcement portion 61 supports the outer side of the foot portion. The outer reinforcement portion 61 has a shape extending along the outer side of the foot portion. A top surface of the outer reinforcement portion 61 is joined to a bottom surface of the weight support portion 50. A bottom surface of the outer reinforcement portion 61 is joined to a top surface of the bottom cover 30. In plan view, no member is present adjacent to the outer reinforcement portion 61 in a lateral direction orthogonal to the longitudinal direction of the insole 10 (direction in which the center line XO extends). In the present embodiment, a material constituting the outer reinforcement portion 61 is a sheet material such as foamed EVA.

The first support portion 61A supports a bone head bottom surface of the first metatarsal. A top surface of the first support portion 61A is joined to a bottom surface of the top cover 20. A bottom surface of the first support portion 61A is joined to a top surface of the bottom cover 30. An outer side of a rear end of the first support portion 61A is joined to a front end of the outer reinforcement portion 61.

The second support portion 61B is joined to the first support portion 61A, and supports from a bone head bottom surface of the second metatarsal to a bone head bottom surface of the fifth metatarsal. A top surface of the second support portion 61B is joined to a bottom surface of the top cover 20. A bottom surface of the second support portion 61B is joined to a top surface of the bottom cover 30.

A material constituting the first support portion 61A is preferably softer than a material constituting the second support portion 61B. In the present embodiment, the material constituting the first support portion 61A is, for example, a sheet material such as a low rebound cushion containing foamed urethane. The material constituting the second support portion 61B is a sheet material such as foamed EVA.

The hind foot post 62 supports the heel. The hind foot post 62 stabilizes the calcaneus at any angle at a tilt in the frontal plane of the weight support portion 50 to guide the subtalar joint to the intermediate position. An outer side of a distal end of the hind foot post 62 is joined to a rear end of the outer reinforcement portion 61. A top surface of the hind foot post 62 is joined to a bottom surface of the weight support portion 50. A bottom surface of the hind foot post 62 is joined to a top surface of the heel grip 40. In other words, the hind foot post 62 is sandwiched between the weight support portion 50 and the heel grip 40. In the present embodiment, a material constituting the hind foot post 62 is a sheet material such as foamed EVA.

The extension 70 supports the toe. The extension 70 has a shape similar to a semicircle that supports substantially the entire toe. A top surface of the extension 70 is joined to a bottom surface of the top cover 20. A bottom surface of the extension 70 is joined to a bottom surface of the bottom cover 30. A rear end of the extension 70 is joined to front ends of the first support portion 61A and the second support portion 61B. Note that, in a case where it is desired to impart a higher cushioning property from the bone head bottom surface of the first metatarsal to the bone head bottom surface of the fifth metatarsal, the extension 70 may be extended rearward so as to overlap the first support portion 61A and the second support portion 61B. A material constituting the extension 70 can be arbitrarily selected. A material constituting the extension 70 is preferably a material having a cushioning property. In the present embodiment, the material constituting the extension 70 is, for example, a sheet material such as a high rebound cushion containing foamed urethane.

<2. Action and Effect of Insole>

The foot portion is composed of a lateral column including the calcaneus and a medial column including the talus. The talus and calcaneus have pronation and supination motion axes at the subtalar joint, and these motions affect the motion axes of the talonavicular and calcaneocuboid joints. Since the talonavicular joint axis and the calcaneocuboid joint axis are parallel in the pronation of the subtalar joint, a range of joint motion becomes large, so that the foot portion becomes soft. On the other hand, in the supination of the subtalar joint, the talonavicular joint axis and the calcaneocuboid joint axis cross each other, and the range of joint motion is reduced, so that the foot portion is stiff. Note that the pronation is a combined motion of dorsal flexion, eversion, and outward inversion, and the supination is a combined motion of plantarflexion, adduction, and inward inversion.

According to the insole 10, the height HA of the outer portion 81 of the heel cup portion 80 is higher than the height HB of the inner portion 83, in other words, the insole 10 is configured such that when the foot portion is placed, the portion corresponding to the outer side of the side surface of the heel covers the position higher than the portion corresponding to the inner side of the side surface of the heel. Therefore, in a case where the right foot of the user is placed on the top cover 20, the outward inversion motion of the calcaneus, which is one element of pronation, is limited. Since the subtalar joint can be suitably guided from a pronation position to an intermediate position, the knee joint is stabilized. Therefore, it is possible to suppress the knee joint from being upset in the left-right direction.

<3. Effects of Present Embodiment>

In the insole 10 configured as described above, the following effects can be further obtained.

<3-1>

Since the insole 10 has the reinforcement portion 60 joined to the bottom surface of the weight support portion 50, the rigidity of the weight support portion 50 is increased.

<3-2>

The reinforcement portion 60 includes the outer reinforcement portion 61 that supports the outer side of the foot. Since the rigidity of the outer side of the weight support portion 50 is increased, it is possible to suppress the outer side of the foot portion from sinking when a load acts. For this reason, the holding of an outer longitudinal arch is promoted, in other words, a force in an outward inversion direction is continuously applied to a transverse tarsal joint.

When the force in the outward inversion direction is applied to the transverse tarsal joint, the shapes of adjacent calcaneal and cuboidal joints cause the two bones to mesh with each other, causing compressive stress. Therefore, the transverse tarsal joint is locked. Note that the calcaneus belongs to a unit called "hind foot" (posterior portion of foot composed of talus and calcaneus), and the cuboid bone belongs to a unit called "front foot" (all bones in front of the unit except the talus and the calcaneus).

In a case where the transverse tarsal joint is locked, the joint between the hind foot and the front foot is strengthened, so that the rigidity of the entire foot portion is enhanced. Therefore, the stability of the foot portion, the lower limb, and the body is improved.

Furthermore, since the rigidity of the outer side of the weight support portion is increased, it is possible to suppress falling of the foot portion outward, falling of the lower leg outward, falling of the thigh outward, falling of the body in the left-right direction, displacement of the center of gravity in the left-right direction, and the like. Furthermore, since the joint between the front foot and the hind foot becomes strong, it is possible to suppress generation of a force that causes a joint located above the foot portion to bend in the left-right direction. Note that examples of the joint located above the foot portion include an ankle joint between the foot portion and the lower leg, a knee joint between the lower leg and the thigh, a hip joint between the thigh and the pelvis, a sacral vertebral joint between the pelvis and the vertebrae, and an intervertebral joint between the vertebrae. In particular, in a case where the knee joint is described as a specific example, when the lower leg falls outward, the knee joint is displaced outward from a position where the knee joint originally located, so that an adduction force, that is, a force promoting a so-called O leg acts on the knee joint. According to the insole 10, the application of such a force to the knee joint is suppressed.

<3-3>

The material constituting the first support portion 61A is softer than the material constituting the second support portion 61B. Since the bone head of the first metatarsal can drop lower than from the bone head of the second metatarsal to the bone head of the fifth metatarsal, for example, in a case where the insole 10 is an insole for golf, a state in which the first row of the foot portion is in plantarflexion can be smoothly formed in a golf swing motion. Since a user can easily recognize the bone head of the first metatarsal, for example, the user can easily execute a motion of kicking the bone head of the first metatarsal, which is important in the golf swing motion, in other words, a motion of kicking the ground with the thenar.

<3-4>

Since the height HA of the outer portion 81 of the heel cup portion 80 is higher than the height HB of the inner portion 83, the heel portion of the shoe is suppressed from being pushed outward by the insole 10 as compared with the conventional insole in which the height of the heel cup portion is substantially constant. Therefore, the fit feeling between the user's foot portion and the shoe is enhanced. Note that, in order to suitably guide the subtalar joint to the intermediate position, for example, an insole (hereinafter referred to as "virtual insole") in which the height HB of the inner portion 83 is configured to be substantially the same as the height HA of the outer portion 81 can be considered. In the virtual insole, since the heel portion of the shoe is pushed outward, the fit feeling between the foot portion of the user and the shoe is reduced. In the insole 10 of the present embodiment, the height HA is sufficiently high, and the height HB is low, so that the subtalar joint can be suitably guided to the intermediate position while suppressing the decrease in the fit feeling between the foot of the user and the shoe.

<3-5>

Since the subtalar joint is guided from the pronation position to the intermediate position, in a case where the insole 10 is a golf insole, the rigidity of the foot portion increases in a golf swing motion. Therefore, since the lower body is stabilized, the user can perform a swing with a sense of stability.

<3-6>

In a case where the insole 10 is a golf insole, the outer side of the calcaneus is fixed by the outer portion 81 of the heel cup portion 80 at the time of the backswing and the follow-through, and the calcaneus is suppressed from going outward and being displaced outward, so that the movement of the axis of the body to the left and right is reduced.

<3-7>

Since the rigidity of the outer side of the weight support portion 50 is increased by the outer reinforcement portion 61, in a case where the insole 10 is a golf insole, the movement of the axis of the body to the left and right is reduced at the time of the backswing and the follow-through.

<4. Modifications>

The above embodiment is an example of a form that can be taken by the insole according to the present invention, and is not intended to limit the form. The insole according to the present invention may take a form different from the form exemplified in the embodiment. An example thereof is a form in which a part of the configuration of the embodiment is replaced, changed, or omitted, or a form in which a new configuration is added to the embodiment. Some examples of modifications of the embodiment will be described below. Note that the following modifications can be combined with each other within a range not technically contradictory.

<4-1>

In the heel cup portion 80, at least one of the rear portion 82 and the inner portion 83 may be omitted.

<4-2>

The first support portion 61A and the second support portion 61B may be made of the same material. The outer reinforcement portion 61, the first support portion 61A, the second support portion 61B, and the hind foot post 62 may be made of different materials. At least one of the first support portion 61A and the second support portion 61B may be omitted from the insole 10.

DESCRIPTION OF REFERENCE SIGNS

10: Insole
50: Weight support portion
60): Reinforcement portion
61: Outer reinforcement portion
61A: First support portion
61B: Second support portion
80: Heel cup portion

The invention claimed is:

1. An insole comprising a heel cup structure and a reinforcement structure capable of supporting a heel of a human foot, wherein the insole is insertable into and removable from a shoe, and wherein the heel cup structure has a plantar shape that extends from a rear end of the insole to a front end of the insole corresponding to a position in a vicinity of a metatarsal bonehead of a human foot if placed into the insole, and has an outer cup side that is capable of supporting an outer side of a heel and an inner cup side that is capable of supporting an inner side of a heel, wherein the outer cup side height is greater than the inner cup side height, such that when a human foot is placed into the insole, the outer cup side covers a portion of the heel at a higher position than the portion of the heel covered by the inner cup side; and wherein the reinforcement structure is joined to a bottom surface of the heel cup portion and comprises:

a hind foot post extending from a rear end of the insole to a hind foot post front end corresponding to a position in a vicinity of a front end of a heel of a human foot if placed into the insole and supporting a heel portion of the of the heel cup structure, an outer reinforcement portion joined to and extending from the hind foot post front end to a front end at a position in a vicinity of a fifth metatarsal bonehead of a human foot if placed into the insole and extending laterally from an outer side of the insole to a central portion of the insole but not to an inner side of the insole, wherein the outer reinforcement portion to an outer longitudinal arch portion of a human foot if placed into the insole, a multiple metatarsal support portion joined to and extending from the outer reinforcement portion front end to an insole front end to include a surface that is capable of supporting bottom surfaces of toes of second to fifth metatarsal bones of a human foot if placed into the insole, and a first metatarsal support portion joined to the multiple metatarsal support portion and including a surface that is capable of supporting a bottom surface of a toe of a first metatarsal bone of a human foot if placed into the insole.

2. The insole according to claim 1, wherein the first metatarsal support portion is formed from a material that is softer than that of the multiple metatarsal support portion.

* * * * *